US011788332B2

(12) United States Patent
Jadhav et al.

(10) Patent No.: US 11,788,332 B2
(45) Date of Patent: Oct. 17, 2023

(54) HINGE SUPPORT

(71) Applicant: WHIRLPOOL CORPORATION, Benton Harbor, MI (US)

(72) Inventors: Tushar Sopan Jadhav, Pune (IN); Vishal Shankar Marathe, Pune (IN); Mahalingappa Chudamani Mulimani, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/987,479

(22) Filed: Aug. 7, 2020

(65) Prior Publication Data

US 2022/0042361 A1 Feb. 10, 2022

(51) Int. Cl.
*E05D 5/04* (2006.01)
*E05D 3/02* (2006.01)

(52) U.S. Cl.
CPC ..... *E05D 5/046* (2013.01); *E05D 3/02* (2013.01); *E05D 2700/04* (2013.01); *E05Y 2900/308* (2013.01)

(58) Field of Classification Search
CPC ... E05D 11/10; E05D 2011/1035; E05D 3/02; E05D 5/04; E05D 5/042; E05D 5/14; E05D 5/16; E05D 7/12; E05D 7/123; E05D 2007/126; E05D 1/00; E05D 1/04; E05D 1/06; E05D 5/046; F24C 15/02; E05F 1/02; E05F 1/04; E05F 1/043; E05F 1/061; E05F 1/063; F25D 23/028; F25D 23/08; E05Y 2900/308
USPC ..... 16/309, 301, 2, 316, 318
See application file for complete search history.

(56) References Cited

U.S. PATENT DOCUMENTS

| | | | | | |
|---|---|---|---|---|---|
| 50,861 | A * | 11/1865 | Upham | E05F 1/063 | 16/318 |
| 236,425 | A * | 1/1881 | Filley | F24C 15/04 | 126/198 |
| 2,938,516 | A | 5/1960 | Saponara | | |
| 3,065,035 | A * | 11/1962 | Biesecker | E05D 7/081 | 84/452 P |
| 3,083,402 | A * | 4/1963 | Foltz | E05D 15/54 | 16/318 |
| 3,113,649 | A * | 12/1963 | Wargo | E05F 1/063 | 49/239 |

(Continued)

FOREIGN PATENT DOCUMENTS

| | | | |
|---|---|---|---|
| DE | 202004003998 | U1 | 6/2004 |
| DE | 10360385 | A1 | 7/2005 |
| EP | 2687786 | A2 | 10/2016 |

*Primary Examiner* — Emily M Morgan
(74) *Attorney, Agent, or Firm* — Price Heneveld LLP

(57) ABSTRACT

A hinge support includes a support plate that defines a first aperture and a second aperture. A pivot has an anchor arm that is disposed within the first aperture defined by the support plate. The pivot has a raised surface, a recessed surface, and a graduated surface that is defined between the raised surface and the recessed surface. A cap is disposed over and operably coupled to the pivot. The cap has a projecting surface, a receiving surface, and a sloped surface that is defined between the projecting surface and the receiving surface. An engagement plate defines an opening and is disposed around the cap. The cap and the engagement plate are configured to translate between a first position and a second position relative to the support plate.

20 Claims, 19 Drawing Sheets

(56) References Cited

U.S. PATENT DOCUMENTS 3,155,088 A 11/1964 Barber
3,398,487 A * 8/1968 Matyas ..... E05F 1/063 49/239
3,628,845 A * 12/1971 Grimm ..... E05F 1/063 312/309
4,070,728 A * 1/1978 Herman ..... E05D 7/0415 16/243
4,090,274 A * 5/1978 Bourgeois ..... E05F 1/063 16/317
4,774,740 A * 10/1988 Gidseg ..... E05D 11/1078 16/344
4,864,691 A * 9/1989 Gidseg ..... E05D 3/04 16/312
5,025,776 A 6/1991 Hanley et al.
5,138,743 A * 8/1992 Hoffman ..... E05F 1/1223 16/303
5,265,311 A * 11/1993 Gard ..... E05F 1/06 16/311
6,122,801 A * 9/2000 Reichert ..... E05D 11/1078 16/284
6,561,180 B1 5/2003 Austin et al.
6,637,319 B1 10/2003 Vanini et al.
7,017,232 B1 3/2006 Priddy
7,747,005 B2 * 6/2010 Konja ..... E05F 1/1223 379/433.13
7,814,620 B2 * 10/2010 Lin ..... H04M 1/0216 16/330
7,823,307 B2 * 11/2010 Gibbs ..... G09F 11/02 40/493
8,166,612 B2 * 5/2012 Bertolini ..... F25D 23/028 16/244
8,510,913 B2 * 8/2013 Kim ..... E05D 11/06 16/334
8,556,330 B2 * 10/2013 Lazarevich ..... E05F 1/1223 296/146.11
9,140,045 B1 * 9/2015 Finkelstein ..... E05D 7/04
9,739,523 B1 * 8/2017 Augsburger ..... E05D 3/02
9,759,430 B2 9/2017 Jadhav et al.
10,260,261 B2 * 4/2019 Reuter ..... E05D 3/02
11,060,333 B2 * 7/2021 Manara ..... E05D 11/10
2005/0188506 A1 * 9/2005 Lee ..... E05F 1/1215 16/376
2008/0010779 A1 * 1/2008 Chen ..... G06F 1/1681 16/339
2010/0218342 A1 9/2010 Bertolini et al.
2013/0067688 A1 * 3/2013 Kim ..... E05D 11/06 16/319
2013/0154464 A1 * 6/2013 Fiori ..... F25D 23/028 16/303
2019/0010299 A1 * 1/2019 Markgraf ..... C08L 59/04
2021/0062560 A1 * 3/2021 Jager ..... E05D 7/081
2021/0247129 A1 * 8/2021 Park ..... E05D 7/04

* cited by examiner

HINGE SUPPORT

BACKGROUND OF THE DISCLOSURE

The present disclosure generally relates to an oven door assembly, and more specifically, to a hinge support for an oven door assembly.

SUMMARY OF THE DISCLOSURE

According to one aspect of the present disclosure, an oven door assembly includes a door having a bottom surface that defines a cavity. The door is rotationally operable between a first position and a second position. A hinge support is operably coupled to the bottom surface of the door. The hinge support includes a support plate that defines a first aperture and a second aperture. A pivot is operably coupled to the support plate and has an anchor arm that is disposed within the first aperture defined by the support plate. The pivot defines a raised surface, a recessed surface, and a graduated surface that is defined between the raised surface and the recessed surface. A cap is operably coupled to the pivot. The cap defines a projecting surface, a receiving surface, and a sloped surface that is defined between the projecting surface and the receiving surface. An engagement plate is coupled to the cap proximate to the bottom surface of the door. The engagement plate selectively engages the support plate in the second position of the door.

According to another aspect of the present disclosure, a hinge support for an oven door includes a support plate that defines a first aperture and a second aperture. A coupling feature is operably coupled to the support plate and extends through the second aperture. A pivot is operably coupled to the coupling feature and has an anchor arm that is disposed within the first aperture defined by the support plate. The pivot defines a graduated surface. A cap is operably coupled to the pivot. The cap defines a sloped surface that is configured to translate along the graduated surface of the pivot. An engagement plate defines an opening and is disposed around the cap. The cap and the engagement plate are configured to translate between a first position and a second position.

According to yet another aspect of the present disclosure, a hinge support includes a support plate that defines a first aperture and a second aperture. A pivot has an anchor arm that is disposed within the first aperture defined by the support plate. The pivot has a raised surface, a recessed surface, and a graduated surface that is defined between the raised surface and the recessed surface. A cap is disposed over and operably coupled to the pivot. The cap has a projecting surface, a receiving surface, and a sloped surface that is defined between the projecting surface and the receiving surface. An engagement plate defines an opening and is disposed around the cap. The cap and the engagement plate are configured to translate between a first position and a second position relative to the support plate.

These and other features, advantages, and objects of the present disclosure will be further understood and appreciated by those skilled in the art by reference to the following specification, claims, and appended drawings.

Figure 1:
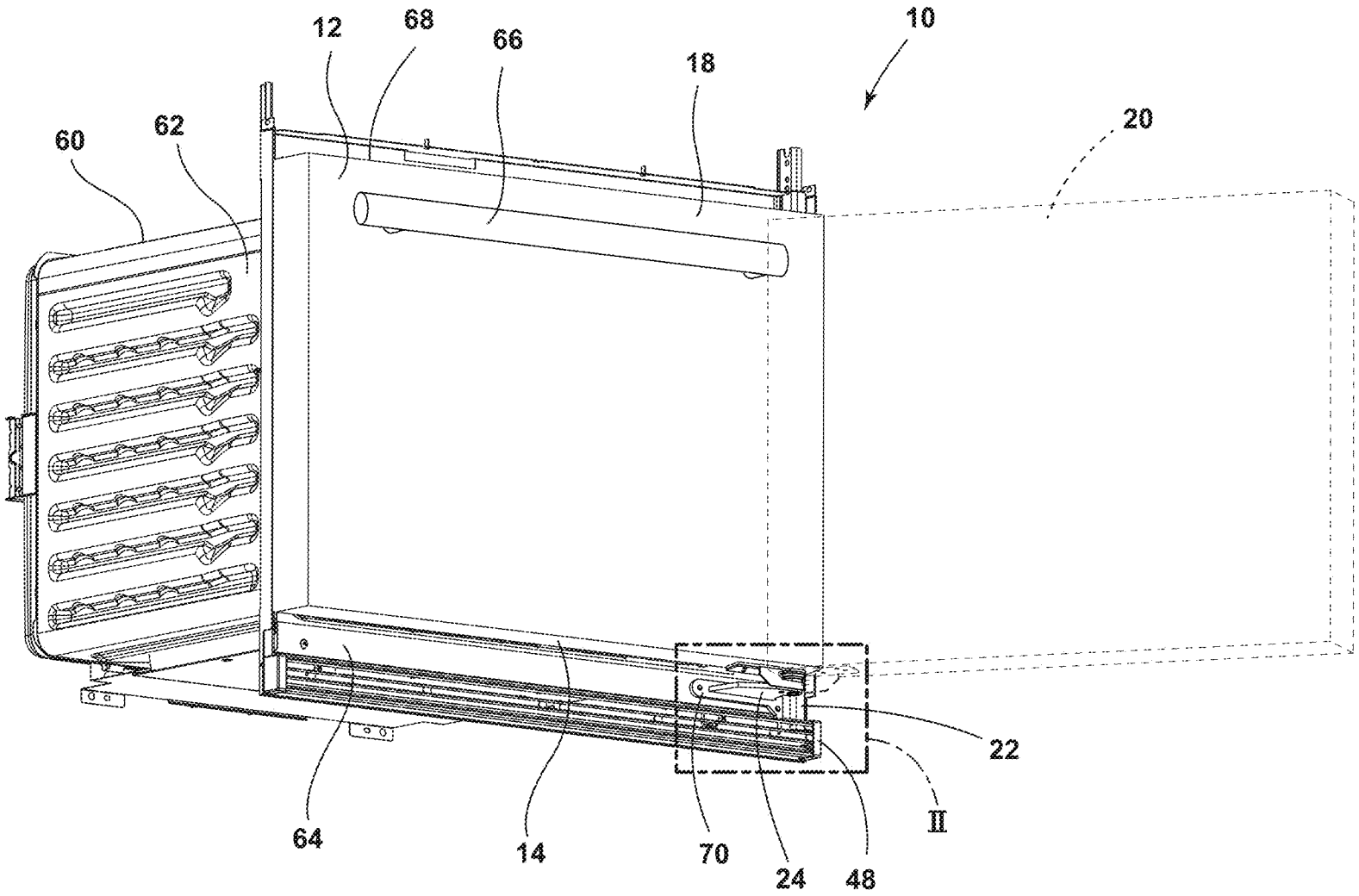
FIG. 1 is a front perspective view of an oven door assembly of the present disclosure with a door in a closed position and the door in phantom in an open position.

The components in the figures are not necessarily to scale, emphasis instead being placed upon illustrating the principles described herein.

DETAILED DESCRIPTION

The present illustrated embodiments reside primarily in combinations of apparatus components related to a hinge support. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-14, reference numeral 10 generally designates an oven door assembly that includes a door 12 having a bottom surface 14 that defines a cavity 16. The door 12 is rotationally operable between a first position 18 and a second position 20, and a hinge support 22 is operably coupled to the bottom surface 14 of the door 12. The hinge support 22 includes a support plate 24 that defines a first aperture 26 and a second aperture 28. A pivot 30 is operably coupled to the support plate 24 and has an anchor arm 32 disposed within the first aperture 26 defined by the support plate 24. The pivot 30 defines a raised surface 34, a recessed surface 36, and a graduated surface 38 defined between the raised surface 34 and the recessed surface 36. A cap 40 is operably coupled to the pivot 30 and defines a projecting surface 42, a receiving surface 44, and a sloped surface 46 defined between the projecting surface 42 and the receiving surface 44. An engagement plate 48 is coupled to the cap 40 proximate to the bottom surface 14 of the door 12. The engagement plate 48 selectively engages the support plate 24 in the second position 20 of the door 12.

Figure 2:
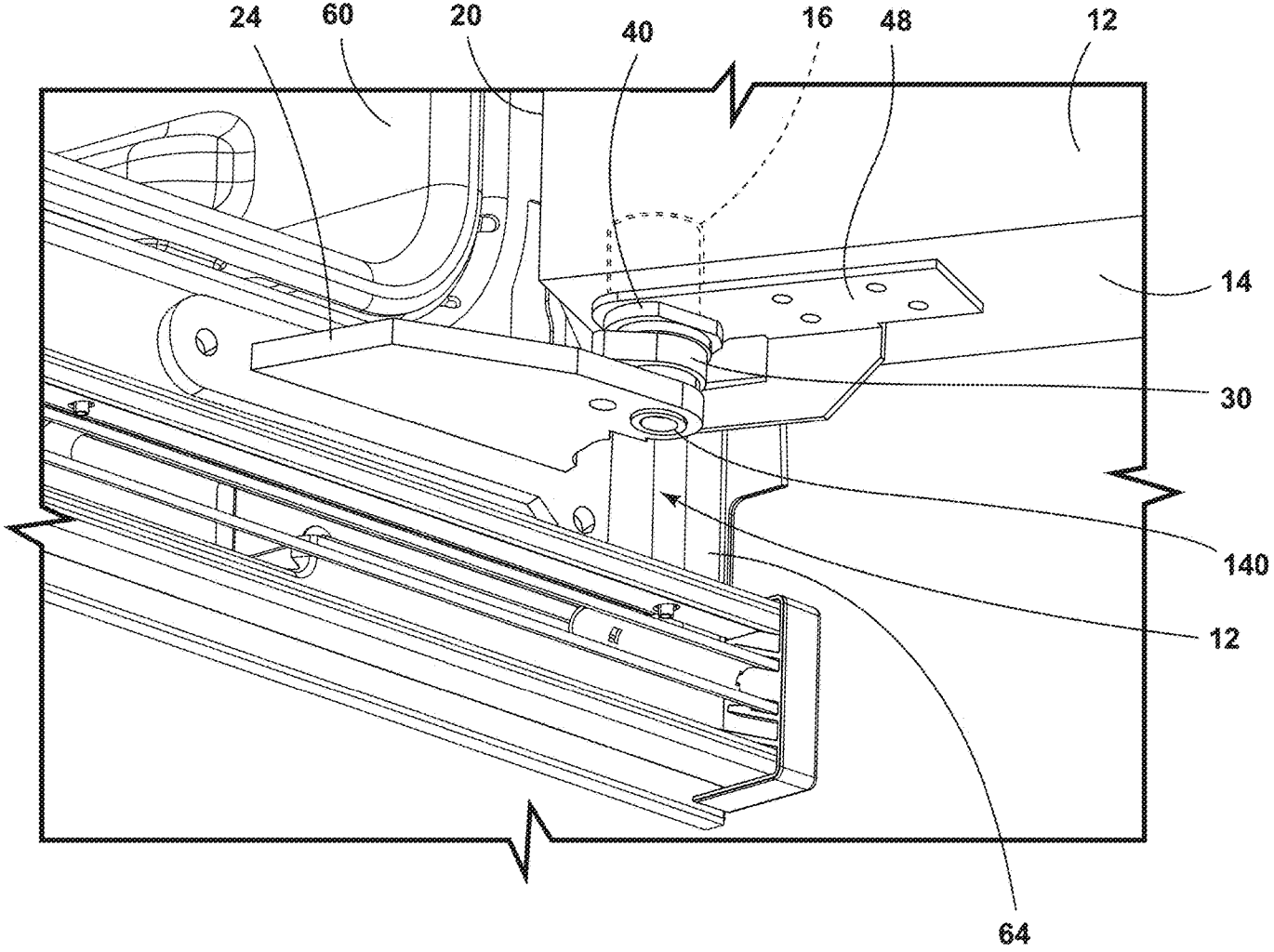
FIG. 2 is an enlarged bottom perspective view of a hinge support of the oven door assembly of FIG. 1 taken at area II.
Figure 3:
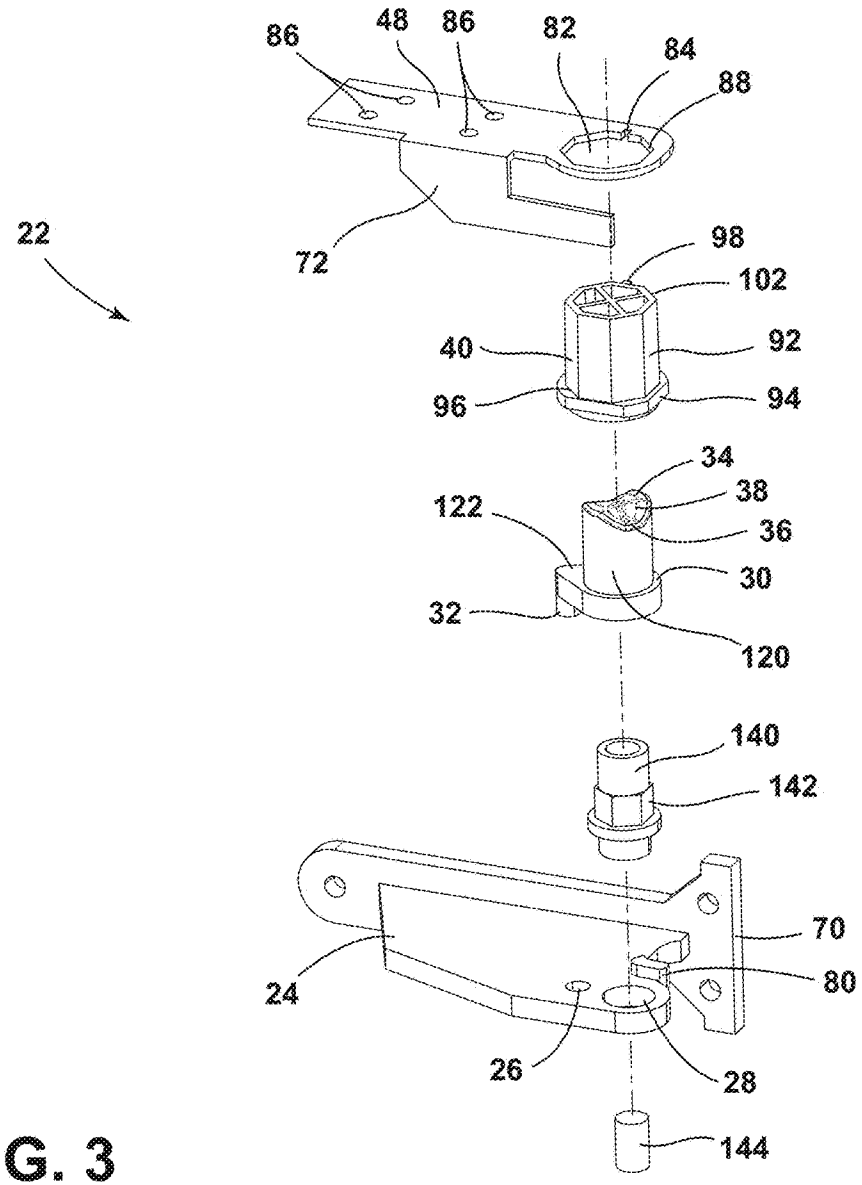
FIG. 3 is an exploded top perspective view of a hinge support of the present disclosure.

Referring to FIGS. 1-3, the oven door assembly 10 is illustrated as being coupled to an appliance 60. The appliance 60 is illustrated as a wall-mounted oven. It is also contemplated that the hinge support 22 described herein can be used with a variety of doors for a variety of appliances including, for example, refrigerators. The appliance 60 includes a casing 62 and a frame 64 to which the door 12 is coupled. The door 12 is illustrated in the first position 18, which may be referred to as the closed position 18. The door 12 is also illustrated in phantom in the second position 20, which may be referred to as the open position 20 of the door 12. It is generally contemplated that the door 12 includes a handle 66 that a user may grasp to articulate the door 12 between the closed position 18 and the open position 20. The handle 66 may be coupled to the door 12 or may be defined by a top surface 68 of the door 12, such that the handle 66 may be integrally formed with the door 12.

The door 12 is operably coupled to the frame 64 of the appliance 60 at least in part via the hinge support 22. Additional coupling mechanisms, such as hinge brackets known in the art, may be used on the top surface 68 of the door 12. The hinge support 22 is coupled to the bottom surface 14 of the door 12 to provide structural support for the door 12 during fluid movement of the door 12. It is generally contemplated that the hinge support 22 includes an attachment plate 70 that is coupled to the frame 64 and the support plate 24 of the hinge support 22. It is also contemplated that the attachment plate 70 may be integrally formed with the support plate 24 to couple the hinge support 22 to the frame 64. As illustrated in FIG. 2, the cap 40 and the pivot 30 are partially disposed in the cavity 16 of the door 12, and the engagement plate 48 is coupled to the bottom surface 14 of the door 12 between the cap 40 and the bottom surface 14. As described in further detail below, the door 12, the cap 40, and the engagement plate 48 rotate about the pivot 30 between the open and closed positions 20, 18, and the engagement plate 48 includes an engagement arm 72 that engages the support plate 24 in the open position 20 of the door 12.

Referring to FIGS. 2-5, the hinge support 22 includes the attachment plate 70, the support plate 24, and the engagement plate 48. As mentioned, the attachment plate 70 couples the door 12 to the frame 64, and the support plate 24 is coupled to the attachment plate 70 and at least partially supports the door 12, described in further detail below. The support plate 24 defines the first aperture 26 and the second aperture 28, and a ledge 80 is disposed on the support plate 24 proximate to the second aperture 28. The engagement plate 48 includes the engagement arm 72 and defines an opening 82, a notch 84 extending from the opening 82, and fastening apertures 86. The engagement plate 48 is coupled to the door 12 via fasteners 90 extending through the fastening apertures 86. The opening 82 is further defined by a plurality of angled edges 88, which also defines the notch 84 radially extending from the opening 82. The engagement plate 48 minimizes the overall rotation of the door 12 in the open position 20, as described below.

The engagement plate 48 is operably coupled to the cap 40, such that the engagement plate 48 is disposed over the cap 40 and the cap 40 extends through the opening 82 defined by the engagement plate 48. The cap 40 includes at least one planar portion 92, which is illustrated as and may be referred to as a plurality of angled walls 92 or angled walls 92, and a flange 94 outwardly extending from a lower portion 96 of the cap 40. The cap 40 may be, but is not limited to, a bushing cam, a bushing bearing, or other known bushings in the art. The cap 40 also includes a rib 98 outwardly extending from one of the angled walls 92. The cap 40 has an interior cavity 100 defined by the angled walls 92 and an enclosed end 102. The enclosed end 102 has the projecting surface 42, the receiving surface 44, and the sloped surface 46 defined therebetween and each of which engages corresponding surfaces of the pivot 30, described in further detail below.

As mentioned above and as illustrated in FIG. 4, the engagement plate 48 is disposed over the cap 40, such that the cap 40 extends through the opening 82 of the engagement plate 48. The rib 98 of the cap 40 fits within the notch 84 defined by the engagement plate 48 to define a mating arrangement. The mating arrangement allows the cap 40 and the engagement plate 48 to move in unison as the door 12 translates between the closed position 18 (FIG. 1) and the open position 20. For example, the rib 98 of the cap 40 is disposed within the notch 84 of the engagement plate 48, such that the engagement plate 48 engages the rib 98 to rotate the cap 40 about the pivot 30.

With further reference to FIGS. 2-5, it is generally contemplated that the angled edges 88 that define the opening 82 of the engagement plate 48 generally correspond and/or have a similar angular shape as the angled walls 92 of the cap 40. The corresponding angled edges 88 and angled walls 92 further define the mating arrangement between the cap 40 and the engagement plate 48. The cap 40 may minimally rotate within the opening 82 due to the engagement of the angled walls 92 with the angled edges 88 of the opening 82. Thus, the rib 98 and the notch 84 may define the mating arrangement of the engagement plate 48 and the cap 40, but the corresponding shape and fit of the angled walls 92 with the angled edges 88 of the opening 82 may also, independently, define the mating arrangement.

Referring now to FIGS. 5-8B, the cap 40 is operably coupled to the pivot 30, such that the cap 40 is disposed over the pivot 30. The receiving surface 44 of the cap 40 generally extends across a diameter 104 of the enclosed end 102 of the cap 40, such that the receiving surface 44 is a single planar surface. Comparatively, the projecting surface 42 includes a first projecting surface 106 and a second projecting surface 108 defined generally perpendicular to the receiving surface 44. The projecting surface 42 has an area $A_1$ that is smaller than an area $A_2$ of the receiving surface 44 and smaller or less than an area $A_3$ of the sloped surface 46. The sloped surface 46 defined between the receiving surface 44 and the projecting surface 42 has a depth $D_1$ of less than 3 millimeters. By way of example, not limitation, the depth $D_1$ of the sloped surface 46 may be approximately 2 millimeters.

Figure 5:
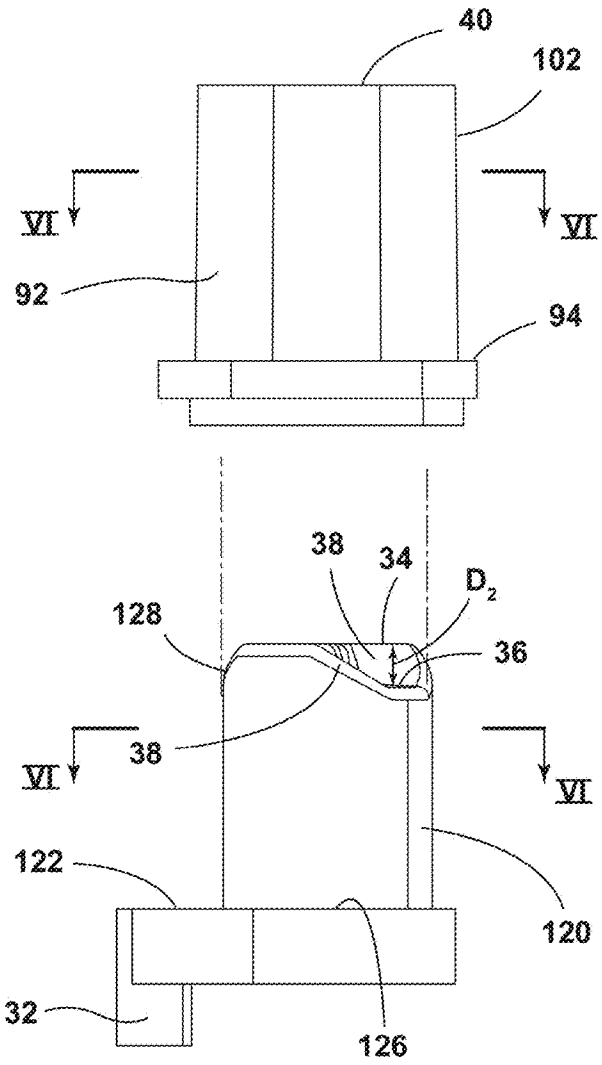
FIG. 5 is a side elevational view of a cap and a pivot of the hinge support of FIG. 3.
Figure 7A:
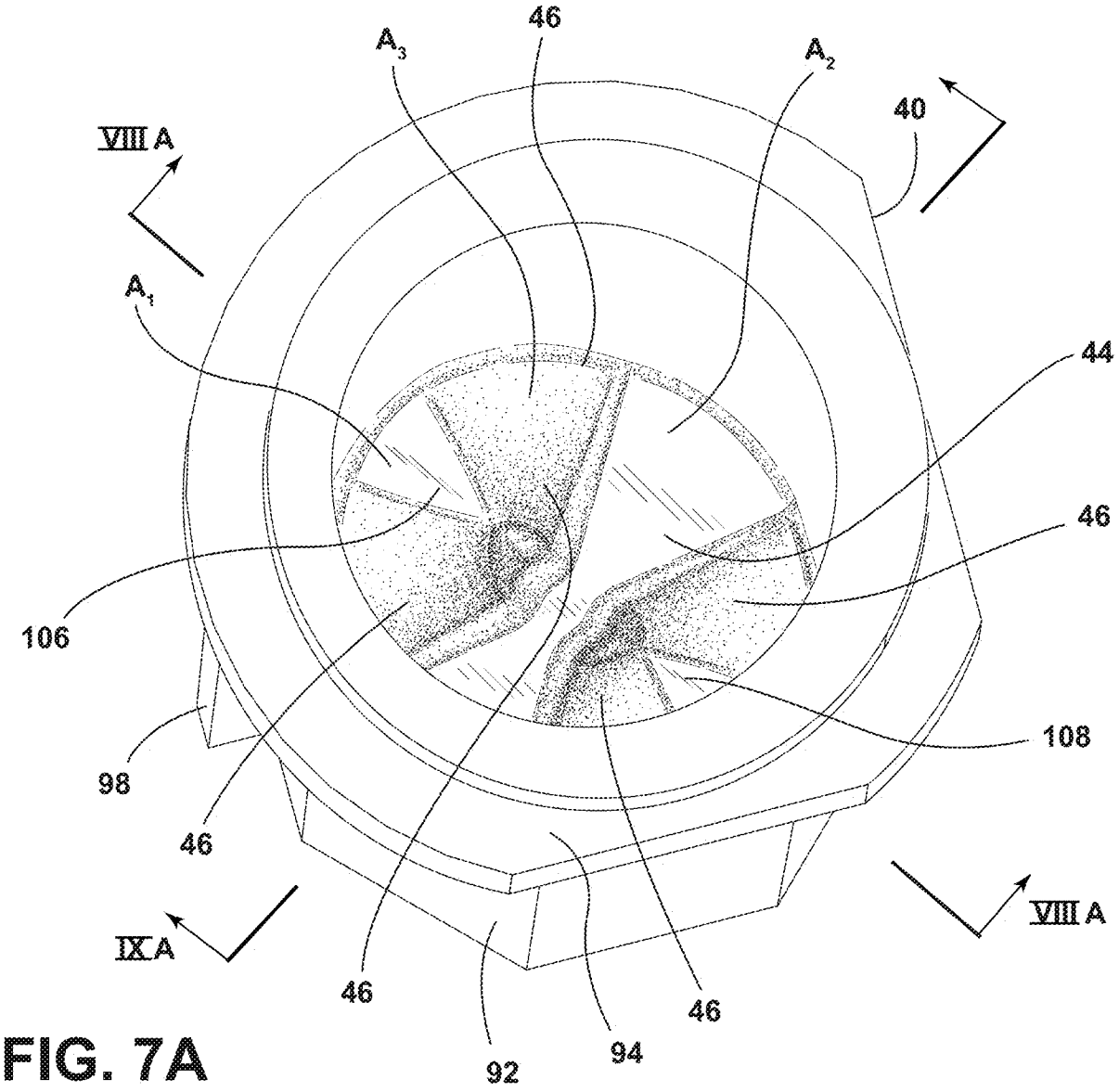
FIGS. 7A and 7B are bottom perspective views of a cap of the present disclosure having a projecting surface, a receiving surface, and a sloped surface.
Figure 7B:
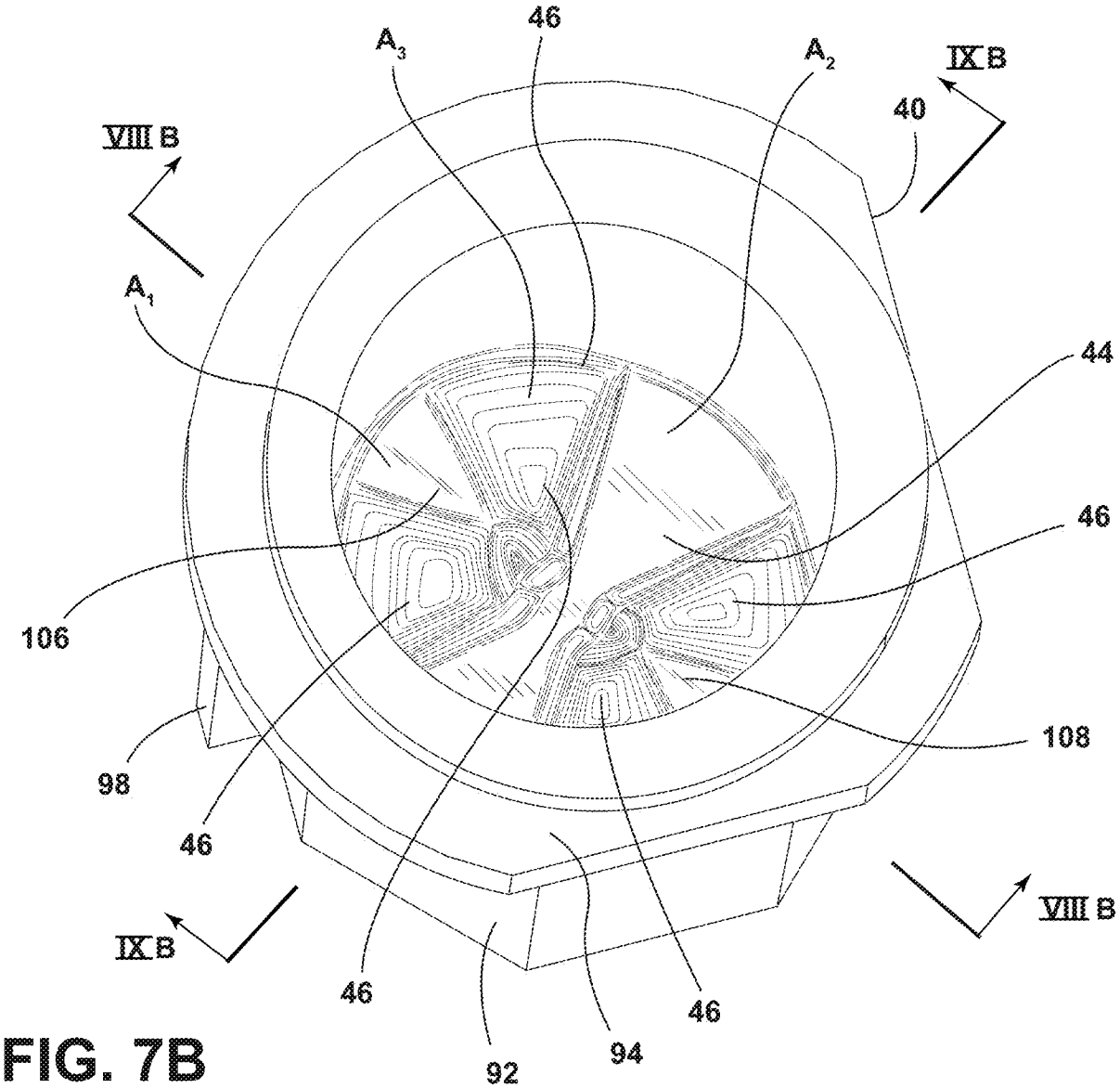
Figure 8A:
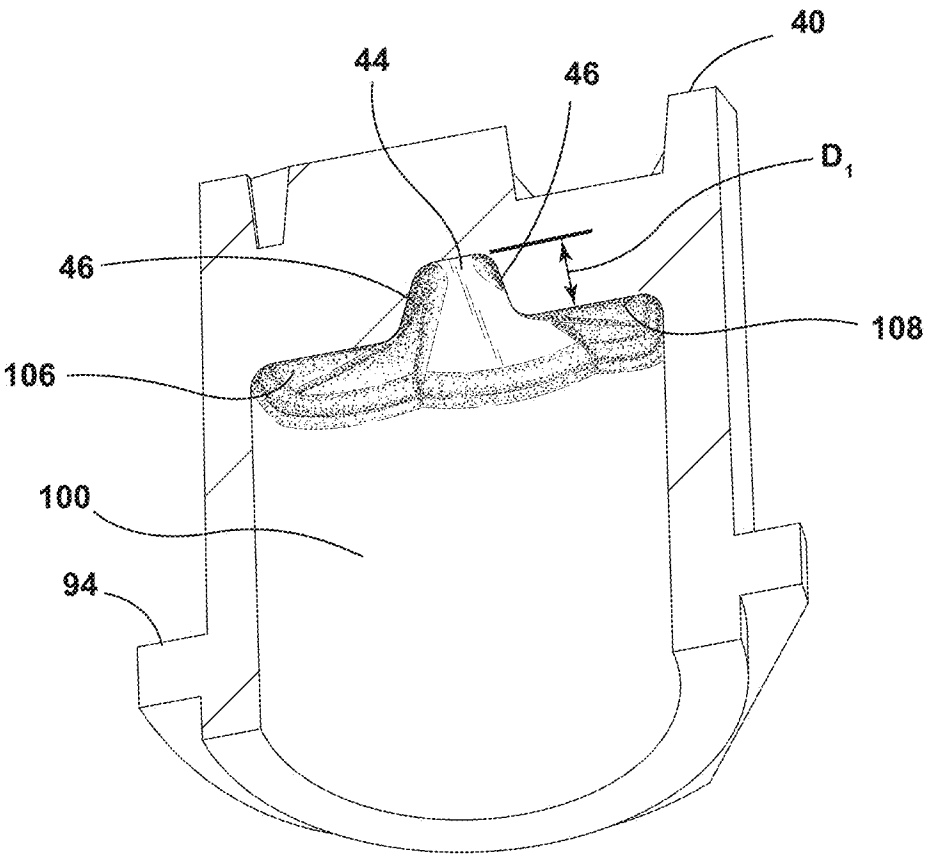
FIGS. 8A and 8B are first bottom perspective cross-sectional views of the cap of FIGS. 7A and 7B, respectively.
Figure 8B:
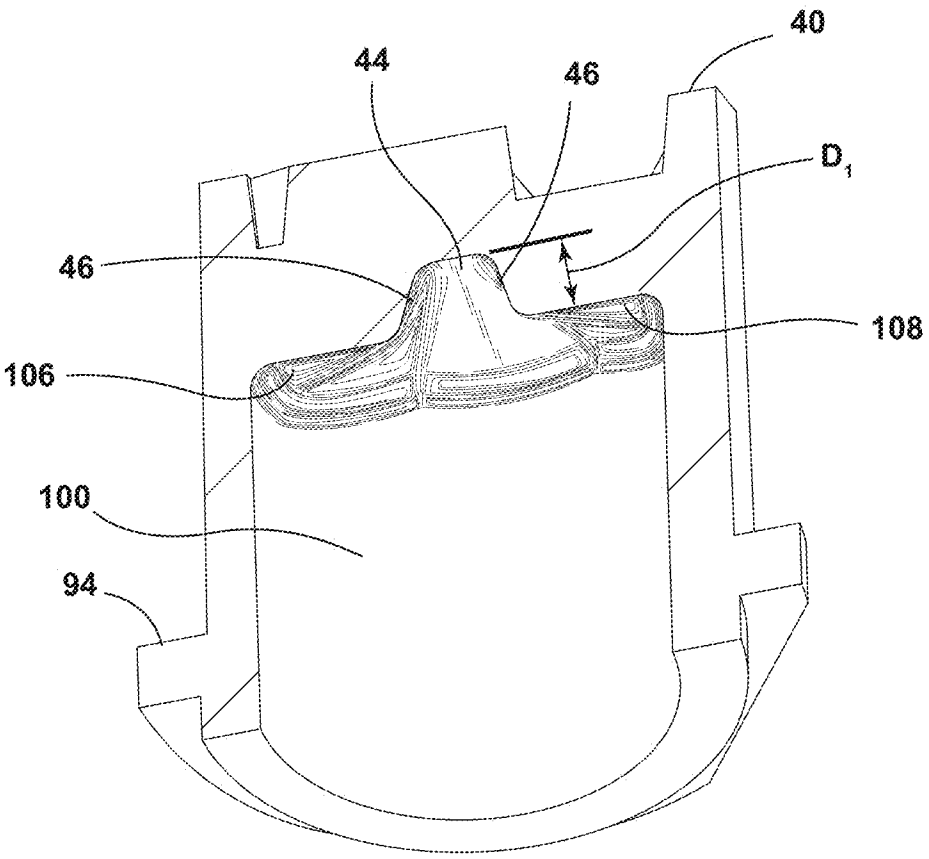
Figure 9A:
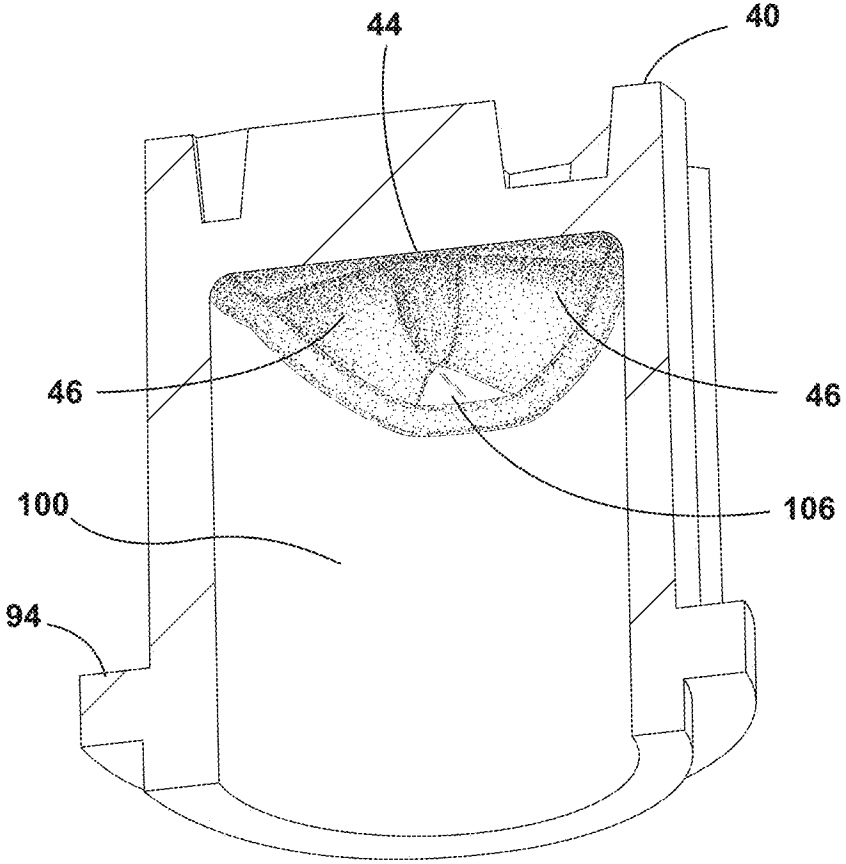
FIGS. 9A and 9B are second bottom perspective cross-sectional views of the cap of FIGS. 7A and 7B, respectively.
Figure 9B:
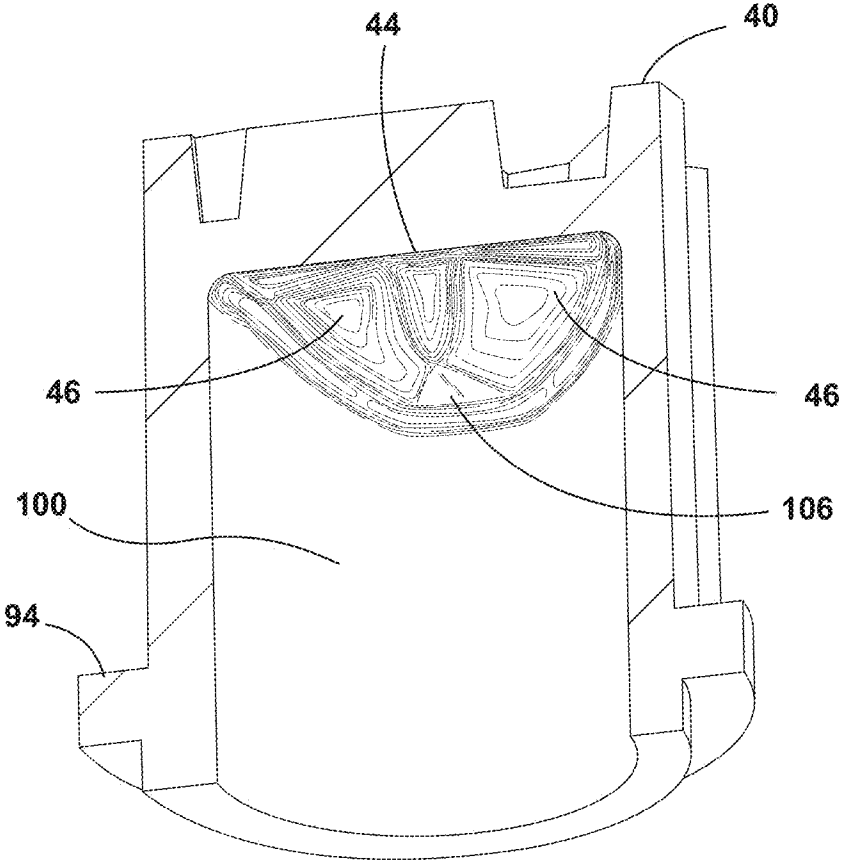
Figure 10A:
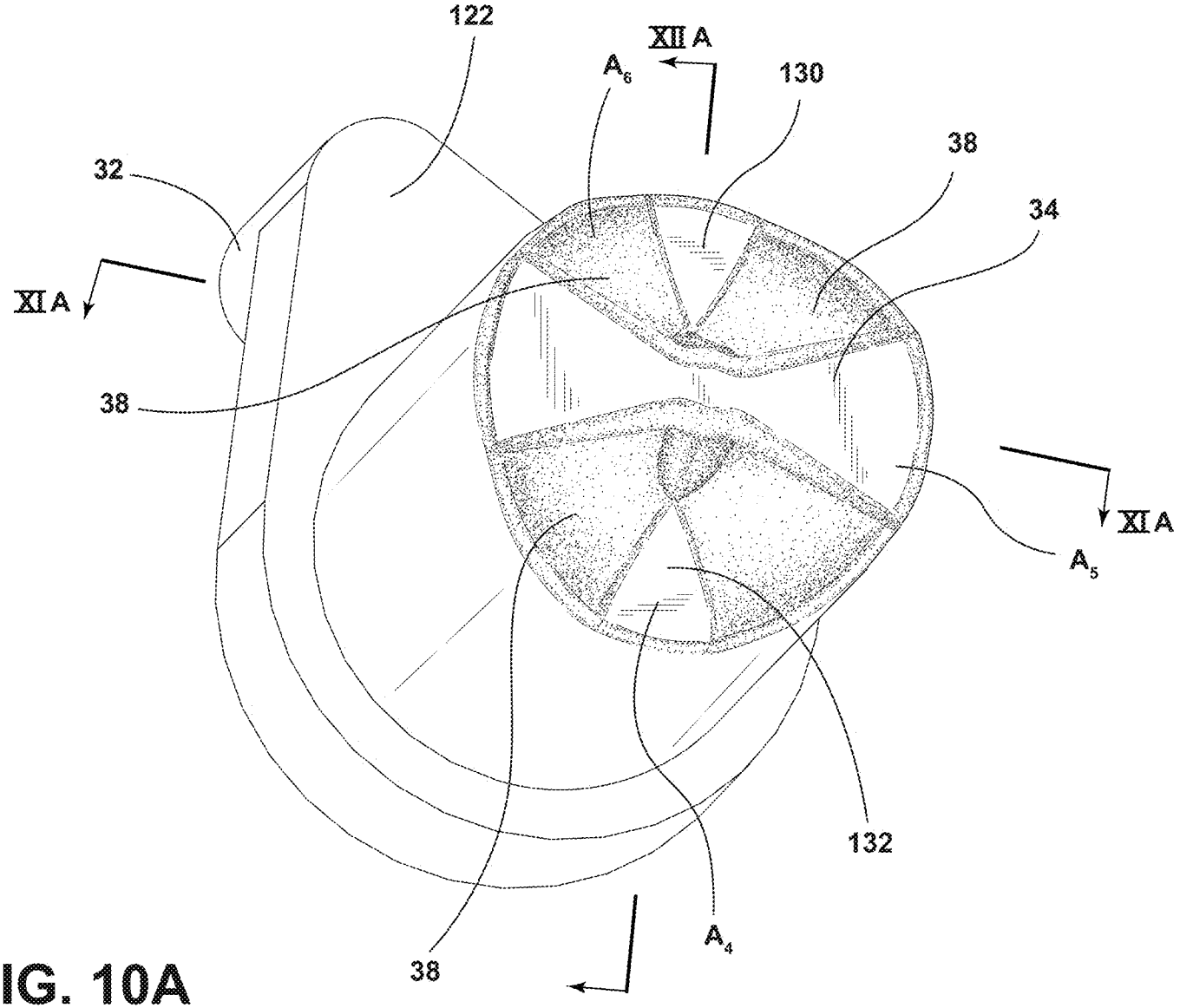
FIGS. 10A and 10B are top perspective views of a pivot of the present disclosure having a raised surface, a recessed surface, and a graduated surface.
Figure 10B:
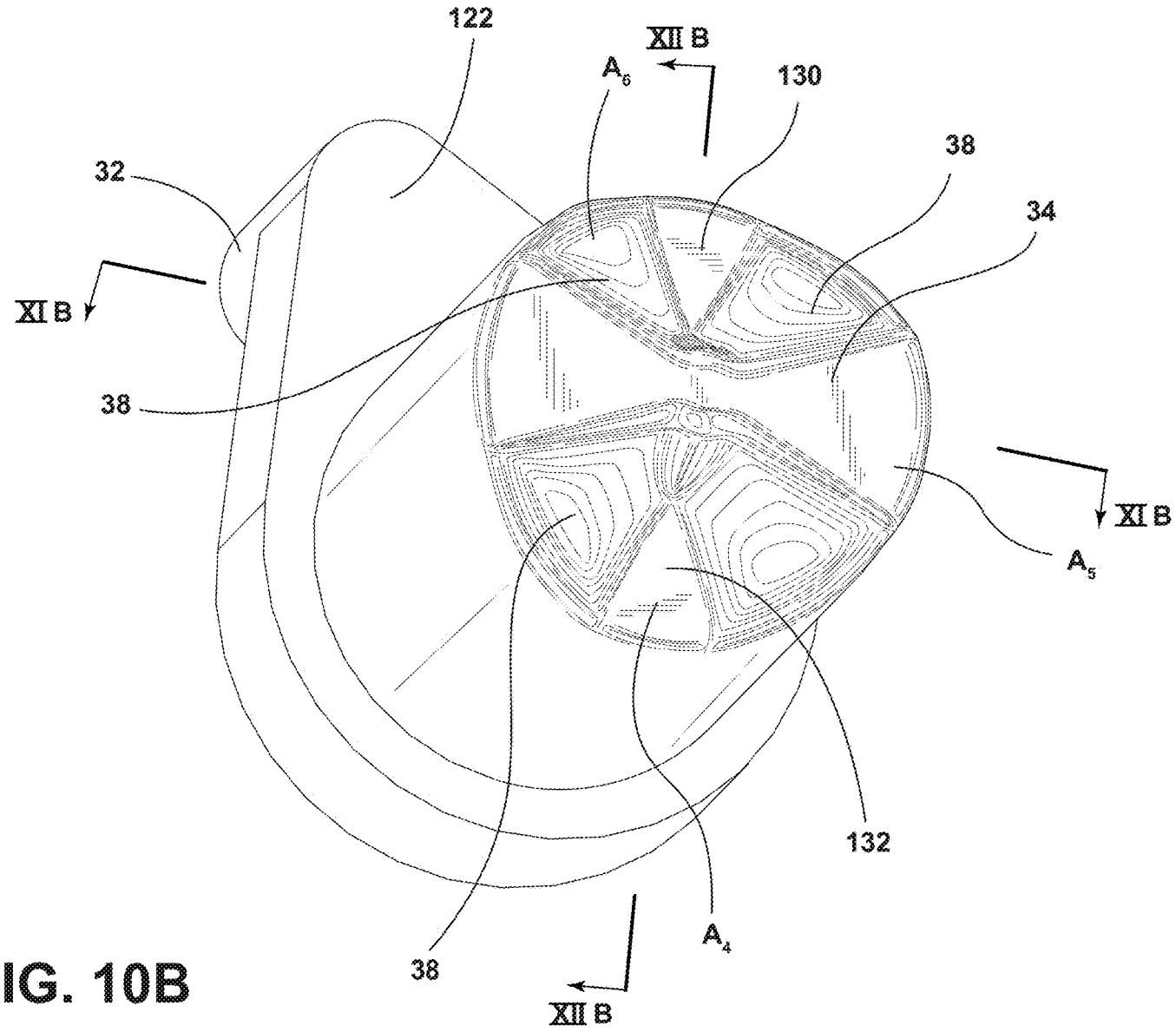
Figure 11A:
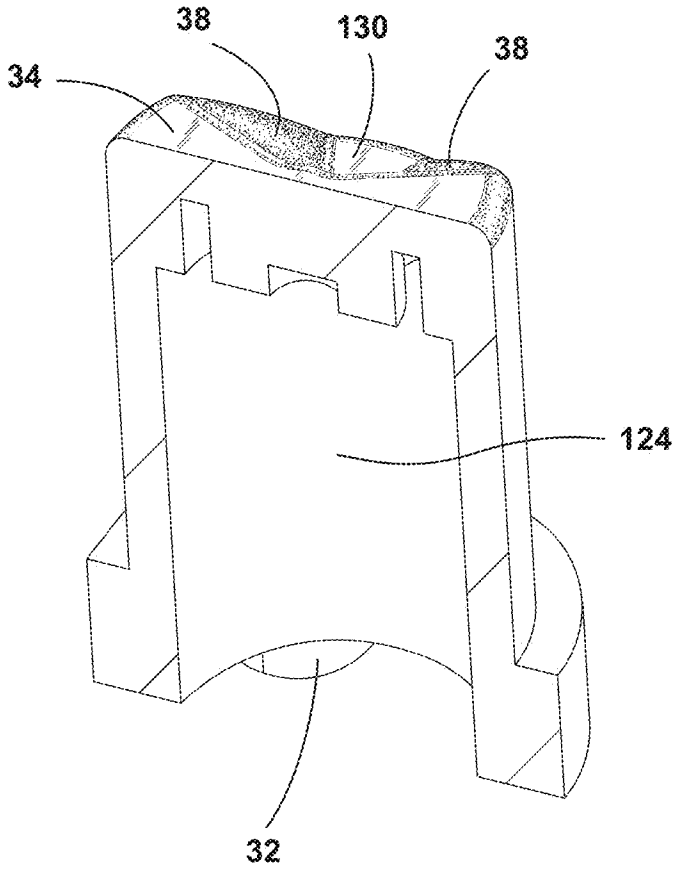
FIGS. 11A and 11B are first top perspective cross-sectional views of the pivot of FIGS. 10A and 10B, respectively.
Figure 11B:
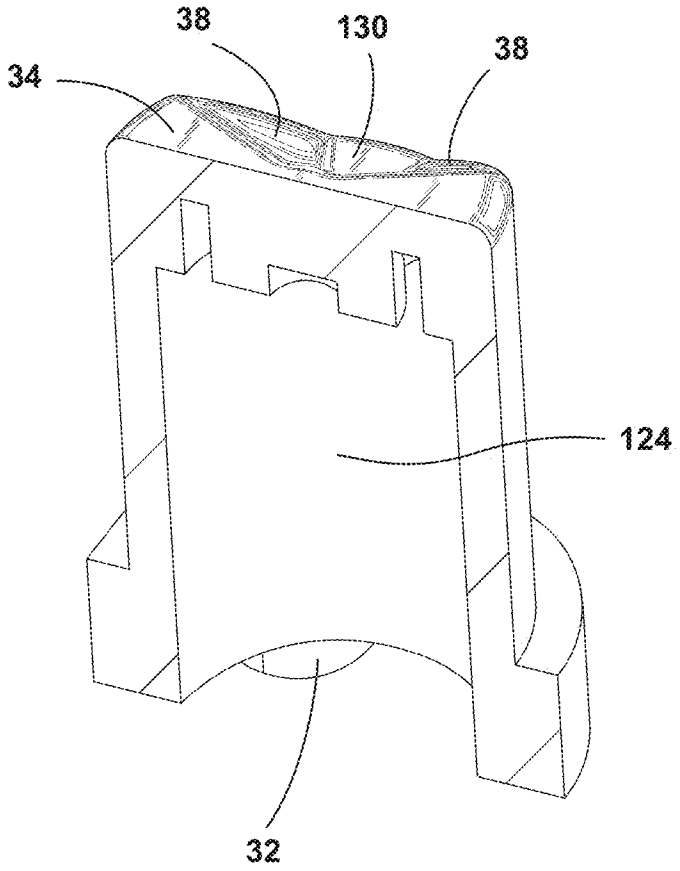
Figure 12A:
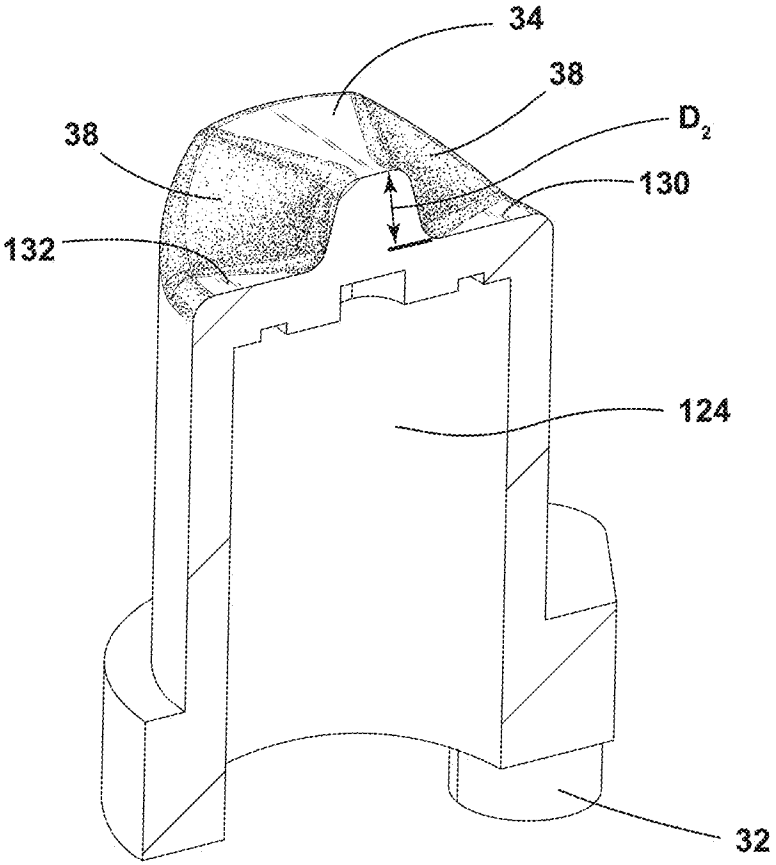
FIGS. 12A and 12B are second top perspective cross-sectional views of the pivot of FIGS. 11A and 11B, respectively.
Figure 12B:
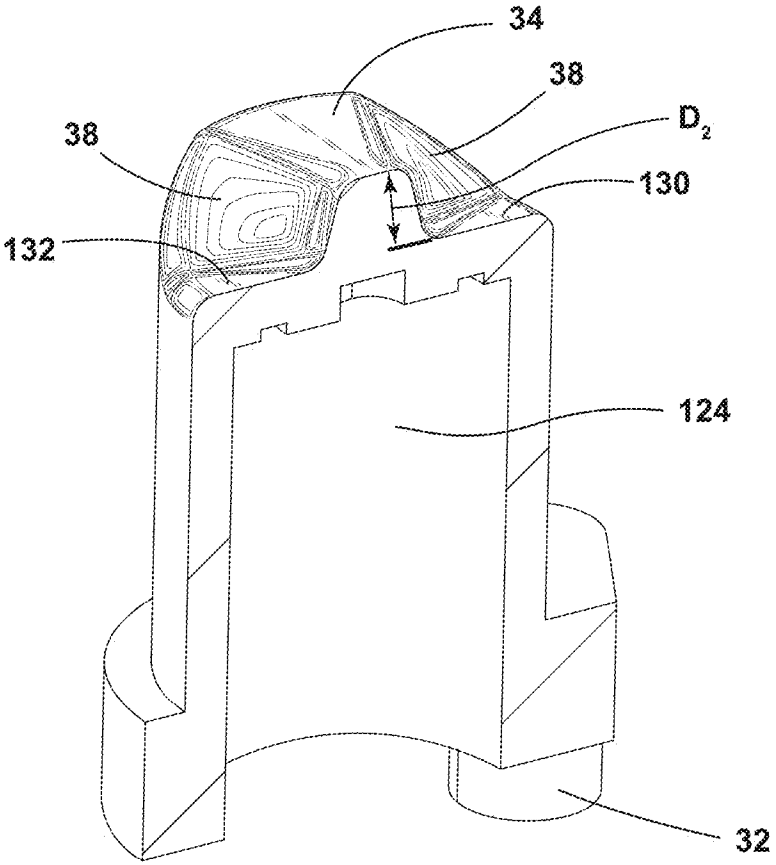

As illustrated in FIG. 5, the pivot 30 has a generally cylindrical body 120 outwardly extending from a base 122 of the pivot 30 from which the anchor arm 32 extends. The cylindrical body 120 and the anchor arm 32 extend from opposing sides of the base 122 to define a generally Z-shaped configuration of the pivot 30. It is generally contemplated that the base 122 of the pivot 30 is generally narrow, such that the anchor arm 32 is adjacent to the cylindrical body 120 on the opposing side of the base 122. The distance between the anchor arm 32 and the cylindrical body 120 minimizes the size of the base 122, such that the strength of the pivot 30 is improved due to the closer arrangement between the anchor arm 32 and the cylindrical body 120.

This configuration anchors the pivot 30 to the support plate 24 while being operably coupled to the cap 40. The cylindrical body 120 is coupled to the base 122 at a proximal end 126 of the cylindrical body 120. It is generally contemplated that the cylindrical body 120 may be hollow, such that a void 124 is defined within the cylindrical body 120. A distal end 128 of the cylindrical body 120 is defined by the raised surface 34, the recessed surface 36, and the graduated surface 38 defined therebetween, described in further detail below.

With further reference to FIGS. 5 and 9A-11B, the recessed surface 36 may include a first recessed surface 130 and a second recessed surface 132 to be configured to selectively receive the first projecting surface 106 and the second projecting surface 108 of the cap 40. As similarly described above with respect to the projecting surface 42 of the cap 40, the recessed surface 36 of the pivot 30 has an area $A_4$ that is smaller than an area $A_5$ of the raised surface 34 and an area $A_6$ of the graduated surface 38. Stated differently, the area $A_5$ of the raised surface 34 and the area $A_6$ of the graduated surface 38 are greater or larger than the area $A_4$ of the recessed surface 36.

The area $A_4$ of the recessed surface 36 is complementary to the area $A_1$ of the projecting surface 42 of the cap 40. The area $A_5$ of the raised surface 34 is complementary to the area $A_2$ of the receiving surface 44 of the cap 40, and the area $A_6$ of the graduated surface 38 is complementary to the area $A_3$ of the sloped surface 46 of the cap 40. It is generally contemplated that the graduated surface 38 has a depth $D_2$ of less than 3 millimeters, which is similar and complementary to the sloped surface 46. By way of example, not limitation, the depth $D_2$ of the graduated surface 38 may be approximately 2 millimeters. The raised surface 34 generally extends across a diameter 134 of the cylindrical body 120, similar to the receiving surface 44 of the cap 40. The raised surface 34 generally defines an hourglass shape across the diameter 134 of the cylindrical body 120.

Figure 4:
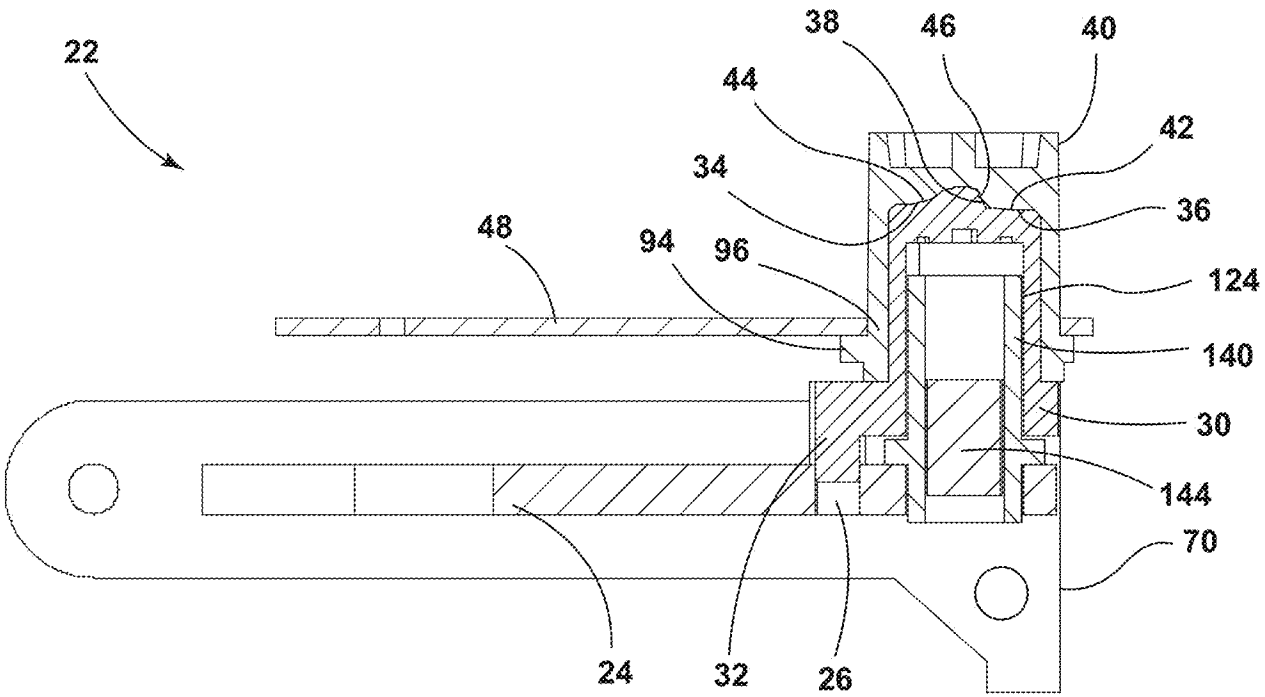
FIG. 4 is a cross-sectional elevational view of a hinge support of the present disclosure.
Figure 6:
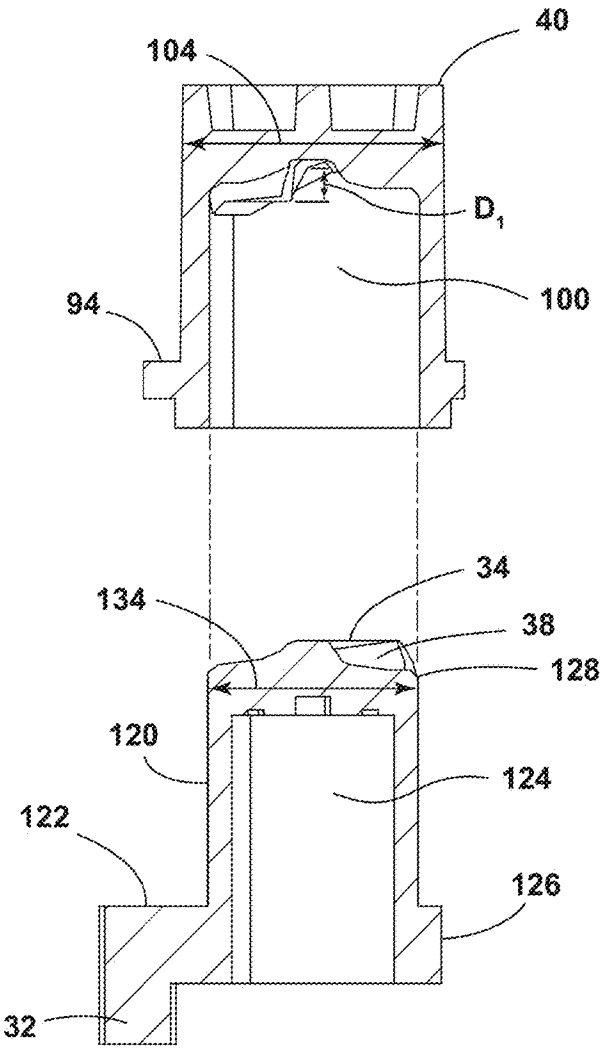
FIG. 6 is a cross-sectional elevational view of the cap and the pivot of FIG. 5 taken along lines VI-VI.
Figure 13:
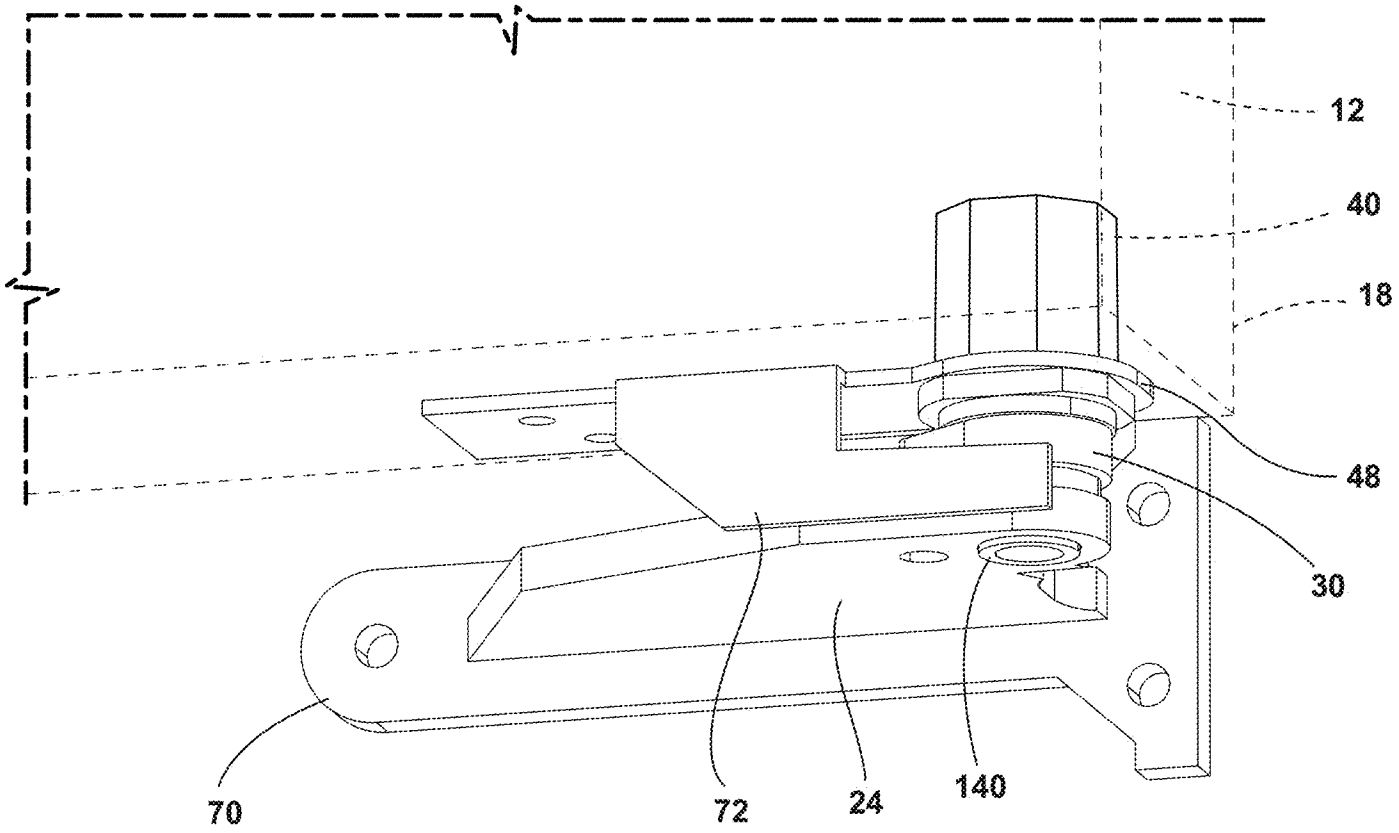
FIG. 13 is a bottom perspective view of a hinge support of the present disclosure coupled to a door in phantom in a closed position.
Figure 14:
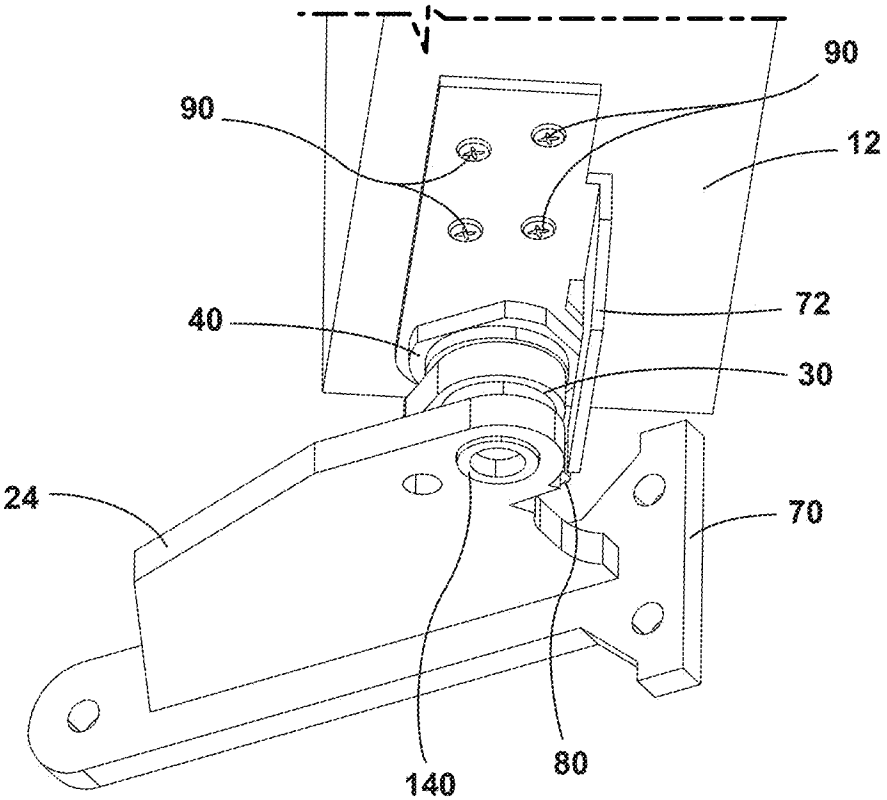
FIG. 14 is a bottom perspective view of the hinge support of FIG. 13 coupled to the door in phantom in an open position.

Referring to FIGS. 4, 13, and 14, the pivot 30 is operably coupled to the support plate 24 via a coupling feature 140. The coupling feature 140 includes an attachment member 142 and a pin 144 configured to selectively couple the attachment member 142 to the support plate 24. It is generally contemplated that the coupling feature 140 may be a clamp configured to engage the cylindrical body 120. Additionally or alternatively, it is generally contemplated that the coupling feature 140 may include a nut and bolt, a screw set, or any other fastening features known in the art. The attachment member 142 may be disposed within the void 124 of the cylindrical body 120, and the pin 144 may secure the attachment member 142 within the cylindrical body 120 to at least partially couple the pivot 30 to the support plate 24.

The cap 40 is disposed over and operably coupled to the pivot 30 to define a selective interlocking arrangement. The interlocking arrangement is utilized as the door 12 is translated between the closed and open positions 18, 20. By way of example, not limitation, the raised surface 34 of the pivot 30 is disposed within the receiving surface 44 of the cap 40 and the projecting surface 42 of the cap 40 is disposed on the recessed surface 36 of the pivot 30 in both the closed position 18 and the open position 20. The cap 40 fluidly rotates about the pivot 30 during translation of the door 12, such that the projecting surface 42 of the cap 40 translates along the graduated surface 38 of the pivot 30.

During the translation of the door 12 between the open and closed positions 20, 18, the projecting surface 42 of the cap 40 translates across the raised surface 34 of the pivot 30. Once the door 12 is in either the closed position 18 or the open position 20 the projection surface 42 is disposed within the recessed surface 36 of the pivot 30. The graduated surface 38 of the pivot 30 and the sloped surface 46 of the cap 40 provide a gradual transition for the door 12 that helps to minimize potential sagging of the door 12 over time.

With further reference to FIGS. 7A-14, the graduated surface 38 of the pivot 30 and the sloped surface 46 of the cap 40 facilitate the fluid movement of the door 12, as opposed to a stepped configuration. Specifically, the depth $D_1$ of the sloped surface 46 and the depth $D_2$ of the graduated surface 38 facilitate the fluid transition of the door 12 between the open and closed positions 20, 18. Further, the area $A_3$ of the sloped surface 46 and the area $A_6$ of the graduated surface 38 provide greater stability for the door 12 during opening and closing due to the increased surface area. In addition, the area $A_1$ of the projecting surface 42 of the cap 40 and the area $A_4$ of the recessed surface 36 of the pivot 30 provide a stabilizing surface to further support the door 12.

The fluid movement of the cap 40 about the pivot 30 may be further facilitated by forming the cap 40 and the pivot 30 from a polyoxymethylene material. Polyoxymethylene is a thermoplastic that provides rigidity and/or stiffness sufficient to withstand levels of high stress. In addition, polyoxymethylene materials have a low coefficient of friction, such that the cap 40 may more fluidly and easily rotate about the pivot 30 when the cap 40 and the pivot 30 are formed from the polyoxymethylene material.

Referring again to FIGS. 1-14, the cap 40 and the pivot 30 are disposed within the cavity 16 of the door 12. As mentioned above, the engagement plate 48 is positioned around the cap 40 and coupled to the bottom surface 14 of the door 12. As the door 12 transitions between the closed position 18 and the open position 20, the engagement plate 48 guides the rotation of the cap 40 about the pivot 30. As described above, the plurality of angled edges 88 of the engagement plate 48 correspond to and engage the plurality of angled walls 92 of the cap 40 as the door 12 rotates. The engagement between the angled edges 88 and the angled walls 92 further defines an interference fit between the engagement plate 48 and the cap 40, such that the cap 40 rotates as the engagement plate 48 is transitioned by the door 12. The interference fit is similar to the mating arrangement that is achieved as a result of the placement of the rib 98 of the cap 40 within the notch 84 of the engagement plate 48, described above. Both configurations provide simultaneous rotation of the cap 40 with the door 12 as a result of the cap 40 being coupled to the engagement plate 48.

The rotation of the door 12 and, consequently, the engagement plate 48 is stopped in the open position 20 once the engagement arm 72 abuts the ledge 80 of the support plate 24. Typically, the projecting surface 42 of the cap 40 is repositioned on the recessed surface 36 of the pivot 30 when the engagement arm 72 is in contact with the ledge 80. The selective interlocking arrangement of the cap 40 and the pivot 30 facilitates the fluid translation of the door 12. For example, the sloped surface 46 of the cap 40 and the graduated surface 38 of the pivot 30 provide a smooth, gradual surface upon which the raised surface 34 of the pivot 30 and the projecting surface 42 may transition, respectively. The fluid translation of the door 12 provides sufficient structural support that the door 12 may experience minimal sagging or wear over time. Stated differently, the graduated surface 38 of the pivot 30 and the sloped surface 46 of the cap 40 minimize sagging of the door 12 during translation between the closed position 18 and the open position 20. Thus, the overall life of the door 12 is increased as a result of the configuration of each corresponding surface of the pivot 30 and the cap 40.

The invention disclosed herein is further summarized in the following paragraphs and is further characterized by combinations of any and all of the various aspects described therein.

According to one aspect of the present disclosure, an oven door assembly includes a door having a bottom surface that defines a cavity. The door is rotationally operable between a first position and a second position. A hinge support is operably coupled to the bottom surface of the door. The hinge support includes a support plate that defines a first aperture and a second aperture. A pivot is operably coupled to the support plate and has an anchor arm that is disposed within the first aperture defined by the support plate. The pivot defines a raised surface, a recessed surface, and a graduated surface that is defined between the raised surface and the recessed surface. A cap is operably coupled to the pivot. The cap defines a projecting surface, a receiving surface, and a sloped surface that is defined between the projecting surface and the receiving surface. An engagement plate is coupled to the cap proximate to the bottom surface of the door. The engagement plate selectively engages the support plate in the second position of the door.

According to another aspect, a hinge support includes a coupling feature that extends through a second aperture defined by a support plate and is operably coupled to a pivot.

According to another aspect, a raised surface of a pivot has an area greater than an area of a recessed surface. A receiving surface of a cap has an area greater than an area of a projecting surface.

According to another aspect, a receiving surface of a cap receives a raised surface of a pivot in a second position of a door.

According to another aspect, a graduated surface of a pivot and a sloped surface of a cap are configured to minimize sagging of a door during translation between a first position and a second position.

According to another aspect, a cap and a pivot define an interlocking arrangement that provides a fluid translation of a door between a first position and a second position.

According to another aspect, a sloped surface has a depth of 2 millimeters.

According to another aspect of the present disclosure, a hinge support for an oven door includes a support plate that defines a first aperture and a second aperture. A coupling feature is operably coupled to the support plate and extends through the second aperture. A pivot is operably coupled to the coupling feature and has an anchor arm that is disposed within the first aperture defined by the support plate. The pivot defines a graduated surface. A cap is operably coupled to the pivot. The cap defines a sloped surface that is configured to translate along the graduated surface of the pivot. An engagement plate defines an opening and is disposed around the cap. The cap and the engagement plate are configured to translate between a first position and a second position.

According to another aspect, a cap is rotatably coupled to a pivot to define a selective interlocking arrangement.

According to another aspect, a graduated surface of a pivot and a sloped surface of a cap provide a fluid rotation of the cap about the pivot.

According to another aspect, a pivot and a cap each comprise a polyoxymethylene material configured to promote a fluid rotation of the cap about the pivot.

According to another aspect, a cap defines a receiving surface and a projecting surface. A pivot defines a raised surface and a recessed surface.

According to another aspect, a receiving surface of a cap is disposed on a raised surface of a pivot that defines a raised surface and a recessed surface.

According to another aspect, a cap is disposed on a raised surface of a pivot in a first position and a second position of a cap.

According to another aspect, a cap is defined by a plurality of angled walls. An opening of an engagement plate is defined by a plurality of angled edges that correspond to the plurality of angled walls of the cap.

According to yet another aspect of the present disclosure, a hinge support includes a support plate that defines a first aperture and a second aperture. A pivot has an anchor arm that is disposed within the first aperture defined by the support plate. The pivot has a raised surface, a recessed surface, and a graduated surface that is defined between the raised surface and the recessed surface. A cap is disposed over and operably coupled to the pivot. The cap has a projecting surface, a receiving surface, and a sloped surface that is defined between the projecting surface and the receiving surface. An engagement plate defines an opening and is disposed around the cap. The cap and the engagement plate are configured to translate between a first position and a second position relative to the support plate.

According to another aspect, a hinge support includes a coupling feature that is coupled to a pivot and extends through a second aperture that is defined by a support plate. The coupling feature and an anchor arm of the pivot fixedly couple the pivot to the support plate.

According to another aspect, a support plate includes a ledge that is proximate to a second aperture. An engagement plate engages the ledge in a second position.

According to another aspect, an engagement plate defines a notch that is proximate to an opening. A cap includes a rib that is disposed within the notch coupling the cap to the engagement plate.

According to another aspect, a cap includes a flange that extends outwardly from a lower portion of the cap. An engagement plate is at least partially disposed on the flange.

According to another aspect, a recessed surface of a pivot has an area less than an area of a graduated surface and an area of a raised surface.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An oven door assembly, comprising:

a door having a bottom surface that defines a cavity, the door being rotationally operable between a first position and a second position; and a hinge support operably coupled to the bottom surface of the door, the hinge support comprising:

a support plate defining a first aperture and a second aperture;

a pivot operably coupled to the support plate and having an anchor arm disposed within the first aperture defined by the support plate, the pivot defining a raised surface forming a single coplanar surface extending across a diameter of a distal end that has a central flat portion positioned at a center axis of the distal end and side flat portions on opposing sides of the central flat portion to define an hourglass shape, recessed surfaces disposed on opposing sides of the raised surface proximate the central flat portion of the raised surface, and graduated surfaces defined between the raised surface and the recessed surfaces, wherein the graduated surfaces are curved between the raised surface and the recessed surfaces;

a cap operably coupled to the pivot, the cap defining projecting surfaces, a receiving surface extending across a diameter of an inner surface of an enclosed end of an interior cavity, and sloped surfaces defined between the projecting surfaces and the receiving surface, wherein the projecting surfaces are disposed on opposing sides of the receiving surface proximate a center of the recessed surface; and an engagement plate coupled to the cap proximate to the bottom surface of the door, the engagement plate selectively engaging the support plate in the second position of the door.

2. The oven door assembly of claim 1, wherein the hinge support further includes a coupling feature extending through the second aperture defined by the support plate and operably coupled to the pivot.

3. The oven door assembly of claim 1, wherein the raised surface of the pivot and the recessed surfaces of the pivot each have a pivot surface area, and wherein the pivot surface area of the raised surface is greater than the pivot surface area of each recessed surface, and wherein the receiving surface of the cap and the projecting surfaces of the cap each have a cap surface area, wherein the cap surface area of the receiving surface is greater than the cap surface area of each projecting surface.

4. The oven door assembly of claim 1, wherein the receiving surface of the cap receives the raised surface of the pivot in the second position of the door.

5. The oven door assembly of claim 1, wherein the cap and the pivot define an interlocking arrangement that provides a smooth translation of the door between the first position and the second position.

6. A hinge support for an oven door, comprising:

a support plate defining a first aperture and a second aperture;

a coupling feature operably coupled to the support plate and extending through the second aperture;

a pivot operably coupled to the coupling feature and having an anchor arm extending from a base, the anchor arm disposed within the first aperture defined by the support plate, the pivot having a cylindrical body with a proximal end coupled to the base and a distal end, the pivot defining a single coplanar raised surface extending across a diameter of the distal end of the cylindrical body and curved graduated surfaces extending from the single coplanar raised surface to recessed surfaces, wherein the single coplanar raised surface has a central flat portion at a center axis of the distal end and side flat portions on opposing sides of the central flat portion along the diameter of the distal end;

a cap operably coupled to the pivot, the cap defining a sloped surface configured to translate along the graduated surfaces of the pivot; and an engagement plate defining an opening and disposed around the cap, wherein the cap and the engagement plate are configured to translate between a first position and a second position.

7. The hinge support of claim 6, wherein the cap is rotatably coupled to the pivot to define a selective interlocking arrangement.

8. The hinge support of claim 6, wherein the pivot and the cap each comprise a polyoxymethylene material configured to further promote a smooth rotation of the cap about the pivot.

9. The hinge support of claim 6, wherein the cap defines an interior cavity with an open end for receiving the pivot and an enclosed end, wherein the enclosed end defines projecting surfaces and a receiving surface forming a single coplanar surface extending across a diameter of the enclosed end with a flat portion at a center axis of the enclosed end.

10. The hinge support of claim 9, wherein the receiving surface of the cap is disposed on the raised surface of the pivot in the first position and the second position of the cap.

11. The hinge support of claim 6, wherein the cap is defined by a plurality of angled walls, and wherein the opening of the engagement plate is defined by a plurality of angled edges corresponding to the plurality of angled walls of the cap.

12. A hinge support, comprising:

a support plate defining a first aperture and a second aperture;

a pivot having an anchor arm disposed within the first aperture defined by the support plate, the pivot having a raised surface forming a single coplanar surface extending across a diameter of a distal end thereof, a recessed surface, and a curved graduated surface defined between the raised surface and the recessed surface, wherein the raised surface has a flat portion positioned at a center axis of the distal end;

a cap disposed over and operably coupled to the pivot, the cap having a projecting surface, a receiving surface forming a single coplanar surface extending across a diameter of an enclosed end of the cap having a flat portion at a center axis of the enclosed end, and a sloped surface defined between the projecting surface and the receiving surface, wherein the receiving surface has a greater width at outer ends compared to a center thereof; and an engagement plate defining an opening and disposed around the cap, wherein the cap and the engagement plate are configured to translate between a first position and a second position relative to the support plate.

13. The hinge support of claim 12, further comprising:

a coupling feature coupled to the pivot and extending through the second aperture defined by the support plate, wherein the coupling feature and the anchor arm of the pivot fixedly couple the pivot to the support plate.

14. The hinge support of claim 12, wherein the support plate includes a ledge proximate to the second aperture, and wherein the engagement plate engages the ledge in the second position.

15. The hinge support of claim 12, wherein the engagement plate defines a notch proximate to the opening, and wherein the cap includes a rib disposed within the notch coupling the cap to the engagement plate.

16. The hinge support of claim 12, wherein the cap includes a flange extending outwardly from a lower portion of the cap, and wherein the engagement plate is at least partially disposed on the flange.

17. The oven door assembly of claim 1, wherein the graduated surfaces of the pivot include central graduated surfaces extending from the central flat portion to the recessed surfaces and edge graduated surfaces extending from the side flat portions to the recessed surfaces.

18. The oven door assembly of claim 1, wherein the receiving surface of the cap has a central flat portion at a center axis of the enclosed end and side flat portions on opposing sides of the central flat portion to form a single coplanar surface.

19. The hinge support of claim 6, wherein the graduated surfaces of the pivot include central graduated surfaces extending from the central flat portion to the recessed surfaces and edge graduated surfaces extending from the side flat portions to the recessed surfaces.

20. The hinge support of claim 12, wherein the curved graduated surfaces of the pivot include central graduated surfaces extending from the flat portion to the recessed surfaces.

* * * * *